US010875040B2

(12) United States Patent
Rancourt et al.

(10) Patent No.: US 10,875,040 B2
(45) **Date of Patent: *Dec. 29, 2020**

(54) PUMP, ENGINE, AND GENERATOR UNIT FOR USE WITH A PRESSURE WASHER

(71) Applicant: Northern Tool & Equipment Company, inc., Burnsville, MN (US)

(72) Inventors: Timothy Rancourt, Lakeville, MN (US); John Schuetz, Owatonna, MN (US); Kyle Hecimovich, Lonsdale, MN (US)

(73) Assignee: NORTHERN TOOL & EQUIPMENT COMPANY, INC., Burnsville, MN (US)

( * ) Notice: Subject to any disclaimer, the term of this patent is extended or adjusted under 35 U.S.C. 154(b) by 122 days.

This patent is subject to a terminal disclaimer.

(21) Appl. No.: 15/942,766

(22) Filed: Apr. 2, 2018

(65) Prior Publication Data

US 2019/0299236 A1 Oct. 3, 2019

(51) Int. Cl.

| | |
|---|---|
| ***B05B 9/04*** | (2006.01) |
| ***B08B 3/02*** | (2006.01) |
| ***F02B 63/04*** | (2006.01) |
| ***B05B 15/60*** | (2018.01) |
| ***B05B 1/24*** | (2006.01) |

(Continued)

(52) U.S. Cl.

CPC ..... *B05B 9/0426* (2013.01); *B05B 1/24* (2013.01); *B05B 15/60* (2018.02); *B08B 3/026* (2013.01); *F02B 63/047* (2013.01); *F02B 63/06* (2013.01); *F04B 17/05* (2013.01); *B08B 2203/027* (2013.01); *F02B 2063/045* (2013.01)

(58) Field of Classification Search

CPC ..... B05B 1/24; B05B 9/0426; B05B 15/60; B08B 3/026; B08B 2203/027; F02B 63/047; F02B 63/06; F02B 2063/045; F04B 17/05; F04B 17/06

See application file for complete search history.

(56) References Cited

U.S. PATENT DOCUMENTS 3,675,851 A * 7/1972 Merfeld ..... A47L 13/26 239/318
3,940,065 A * 2/1976 Ware ..... B05B 5/085 239/146

(Continued)

FOREIGN PATENT DOCUMENTS

AU 2018202435 10/2019
CA 3000252 10/2019

(Continued)

OTHER PUBLICATIONS

"Report dated Apr. 20, 2018 for Chilean Patent Application No. 2018-01043."

(Continued)

*Primary Examiner* — Kevin F Murphy
*Assistant Examiner* — Jonathan J Waddy
(74) *Attorney, Agent, or Firm* — Fafinski Mark & Johnson

(57) ABSTRACT

A pressure washer system comprises a cleaning fluid tank defining a cleaning fluid supply outlet, and a pump, engine and generator (PEG) unit including a pump defining a cleaning fluid pump inlet disposed vertically below the cleaning fluid supply outlet of the cleaning fluid supply tank.

3 Claims, 13 Drawing Sheets

(51) Int. Cl.
*F02B 63/06* (2006.01)
*F04B 17/05* (2006.01)

(56) References Cited

U.S. PATENT DOCUMENTS 4,046,321 A * 9/1977 Hewett ..... B05B 7/0869 239/420
4,967,960 A * 11/1990 Futrell ..... B08B 3/026 239/148
5,601,659 A * 2/1997 Rohrbacher ..... A47L 11/30 134/10
5,653,584 A * 8/1997 Mazzucato ..... F04B 1/148 417/360
6,234,409 B1 * 5/2001 Aslakson ..... B08B 3/026 239/146
6,571,805 B2 6/2003 Hoenisch et al.
6,626,374 B1 * 9/2003 Diedrick ..... B08B 3/026 239/127
6,761,135 B1 * 7/2004 Becktold ..... B08B 3/026 122/396
8,425,203 B2 * 4/2013 Gardner ..... B08B 3/026 417/234
10,359,039 B1 7/2019 Rudnick
D863,369 S 10/2019 Wise
D863,370 S 10/2019 Wise
D863,371 S 10/2019 Wise
2004/0226578 A1 * 11/2004 Guest ..... A47L 11/4044 134/10
2004/0226584 A1 * 11/2004 Guest ..... A47L 11/4044 134/36
2019/0299234 A1 * 10/2019 Schuetz ..... B05B 9/007
2019/0299236 A1 10/2019 Rancourt
2019/0301770 A1 10/2019 Hecimovich
2019/0301817 A1 10/2019 Hecimovich

FOREIGN PATENT DOCUMENTS

CL 2017000788 9/2017
CL 2018001032 9/2018
CL 2018001033 9/2018
CL 2018001034 9/2018
CL 2018001035 9/2018
CL 2018001036 9/2018
CL 2018001037 9/2018
CL 2018001038 9/2018
CL 2018001039 9/2018
CL 2018001040 9/2018
CL 2018001041 9/2018
CL 2018001042 9/2018
CL 2018001043 9/2018
CL 2018001044 11/2018

OTHER PUBLICATIONS

"Letter by Goytia & Associates regarding Office Action/Notification of Examination Report for Chilean Patent Application No. 2018-01043, said letter dated Aug. 7, 2019."
Letter by Goytia & Associaes regarding Office Action/response filed for corresponding Mexican Application No. MX/A/2018/004975, said letter dated Apr. 9, 2019.
Letter by Goytia & Associates with second Office Action issued for corresponding Chilean Patent Application No. 2018-01043, said letter dated Jan. 21, 2020.

* cited by examiner

PUMP, ENGINE, AND GENERATOR UNIT FOR USE WITH A PRESSURE WASHER

TECHNICAL FIELD

The present disclosure relates to pump, engine and generator units for use with pressure washer systems. More specifically, the present disclosure relates to a pump, engine, and generator unit that helps protect the pump of the pressure washer system by providing positive pressure at the pump inlet.

BACKGROUND

Pressure washer systems are routinely used in wide variety of applications to remove debris, dirt, fluids and other substances from surfaces needed to be cleaned. For example, driveways, garage floors, concrete or tile patios, stairs, walkways, decks, home exteriors, fencing, cars and trucks, lawnmowers, dirt bikes, boats or trailers, outdoor furniture, and grills may benefit from being pressure washed. Commercial uses include factories, food processing plants or restaurants, agriculture equipment, construction equipment, earth moving equipment, and mining equipment, etc.

As can be imagined, it is sometimes desirable that the fluid being used to wash an item, such as water, water with chemicals or detergent added thereto, other chemical mixtures, etc. be heated to a certain temperature to help remove the undesirable substance that is clinging to a surface that needs to be cleaned. For example, some organic substances such as grease or fat are difficult to remove unless the temperature of the water used reaches a threshold emulsifying temperature. In some applications, it may be desirable that the water reach a certain temperature such as 120 degrees Celsius so that grease may be removed from a surface.

Often, a pressure washer system is supplied with a fossil fuel supply such as gasoline or diesel to fuel an engine, which powers a pump for expelling the water at the desired pressure. Also, the same fuel is often used as part of an ignition system that creates a flame that heats air that is blown through a heat exchanger, which in turn, heats the water and/or other cleaning fluids that are intended to clean a surface using the pressure washer system. As can be imagined, the amount of fuel burned while maintaining a desired temperature of the cleaning fluid may vary considerably depending on the efficiency of the heat exchanger. If the heat exchanger operates inefficiently, then the profit of a business endeavor using the pressure washer can decrease significantly. Also, emissions to the atmosphere may be increased.

In some applications, heated water or other cleaning fluid is not warranted. Regardless if a heat exchanger is used or if an internal combustion engine is used to power a particular pressure washer system, most pressure washer systems supply the water or other cleaning fluid at a suitably high pressure using a pump. If the supply of water or other cleaning fluid runs low, air may be sucked into the pump, which can cause damage to the pump as the pump may become overheated, experience cavitation, etc. If this occurs often enough or long enough, the pump may fail. This leads to downtime for the pressure washer system and associated economic losses for a business endeavor using that pressure washer system.

Similarly, if for some reason, the pressure at the pump inlet is negative for too long, air may be sucked into the pump, creating cavitation that might cause the pump to be damaged.

Accordingly, it is desirable to develop a pump, engine, and generator unit for use with a pressure washer system that decreases the likelihood of air being introduced into the pump, or otherwise decrease the likelihood of cavitation and the associated risk of damage to the pump.

SUMMARY OF THE DISCLOSURE

A pressure washer system according to an embodiment of the present disclosure is provided. The pressure washer system comprises a cleaning fluid supply tank defining a cleaning fluid supply outlet, and a pump, engine and generator (PEG) unit including a pump defining a cleaning fluid pump inlet disposed vertically below the cleaning fluid supply outlet of the cleaning fluid supply tank.

A pump, engine and generator (PEG) unit according to an embodiment of the present disclosure is provided. The PEG unit comprises a pump, an engine and a generator, a lower pump support platform, an engine and a generator support platform, and an upper frame attachment portion that is positioned vertically above the lower pump support platform.

A method for supplying a cleaning fluid to a pump for a pressure washer according to an embodiment of the present disclosure is provided. The method comprises providing positive pressure at the pump inlet.

DETAILED DESCRIPTION

Figure 1:
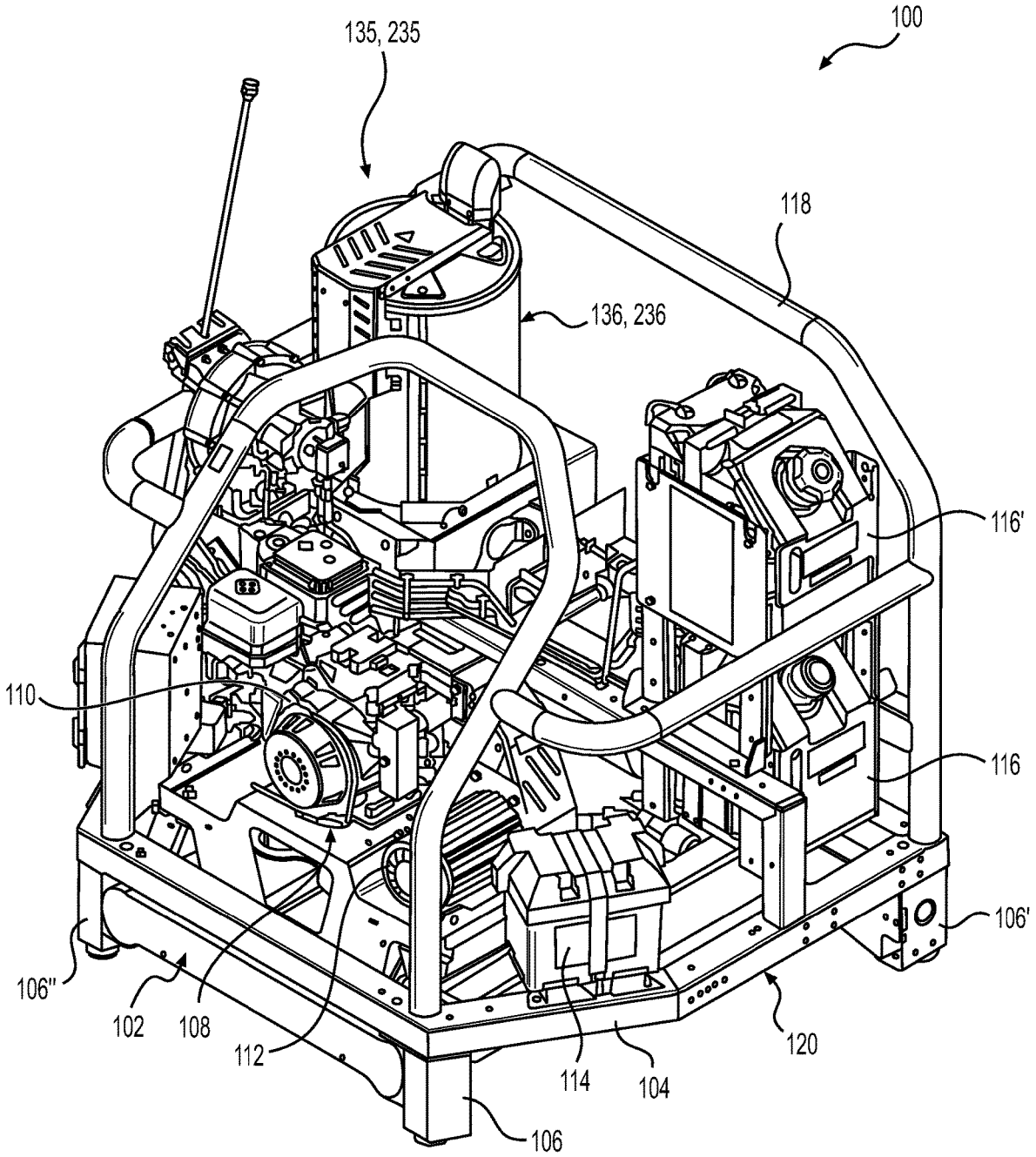
FIG. 1 is a perspective view of a pressure washer mounted on a skid utilizing a blower and heat exchanger assembly according to an embodiment of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

A low cleaning fluid shutdown system, various components of that low cleaning fluid shutdown system, and a pressure washer that may utilize these components and the low cleaning fluid shutdown system will now be described. Also, a method of using a low cleaning fluid shut down system will now be described.

Looking at FIG. 1, a pressure washer 100 that is mounted on a ladder frame 102 is illustrated. Such a skid mounted pressure washer 100 is typically used in immobile or stationary applications near an area where repeated pressure washing is desirable. The skid assembly 120 includes a frame portion 104, cage portion 118, and legs 106 or supports that space the frame portion 104 away from the ground or other support surface. Various systems and assemblies are mounted onto the ladder frame 102 and skid assembly 120.

For example, a pump, engine, and generator assembly, sometimes referred to as a "PEG" (pump, engine, and generator) assembly or unit 108 is shown to be situated near the front of the ladder frame 102. While the engine 110 and generator 112 are shown, the pump 1002 is hidden by the engine 110 in the view of FIG. 1, but may be seen in FIG. 14. Still referring to FIG. 1, a battery 114 is also supplied for starting the engine 110. Once the engine 110 is started, it powers the generator 112 and pump (not shown). The engine 110 is an internal combustion engine that may be powered by any suitable fuel including diesel or gasoline. In other embodiments, the power may be provided by an electrical motor, etc. Two fuel tanks 116 are provided. One fuel tank 116 may supply fuel to the engine 110 and the other fuel tank 116 to the combustion head (not shown in FIG. 1) of the heat exchanger subassembly 136 as will be discussed. Or, both tanks 116 may be connected in series to both the engine 110 and the combustion head.

A blower and heat exchanger assembly 135, 235 are also mounted to the skid assembly 120 on the left side of the skid assembly 120. Heated air is forced through the heat exchanger subassembly 136, 236 that warms water or any other cleaning fluid to a desired temperature. The heated air is created by the combustion head (not shown in FIG. 1) that creates a flame by igniting fuel that is sprayed into a combustion chamber (not shown in FIG. 1).

A cage portion 118 is provided that partially surrounds the various systems and assemblies that are mounted onto the skid assembly 120 to help protect the various systems and assemblies from damage. Also, the ladder frame 102 may be used to lift the skid mounted pressure washer 100 from underneath so that it may be moved as needed or desired. No water tank or other cleaning fluid tank is provided with this embodiment of a skid mounted pressure washer 100 since such a skid mounted pressure washer 100 is intended to remain in a specific place for a prolonged period of time, allowing a fluid line to be directly attached to the skid mounted pressure washer 100 for supplying water or other cleaning fluid to the skid mounted pressure washer 100. Regardless, a low cleaning fluid shutdown system 300 (shown in FIG. 3) may be used with this type of system whether a supply tank is supplied or not. For example, even if a direct water line or other cleaning fluid supply line is used, the supply of cleaning fluid such as water may be interrupted. So, a low cleaning fluid shutdown system 300 may still be employed or be useful.

Figure 2:
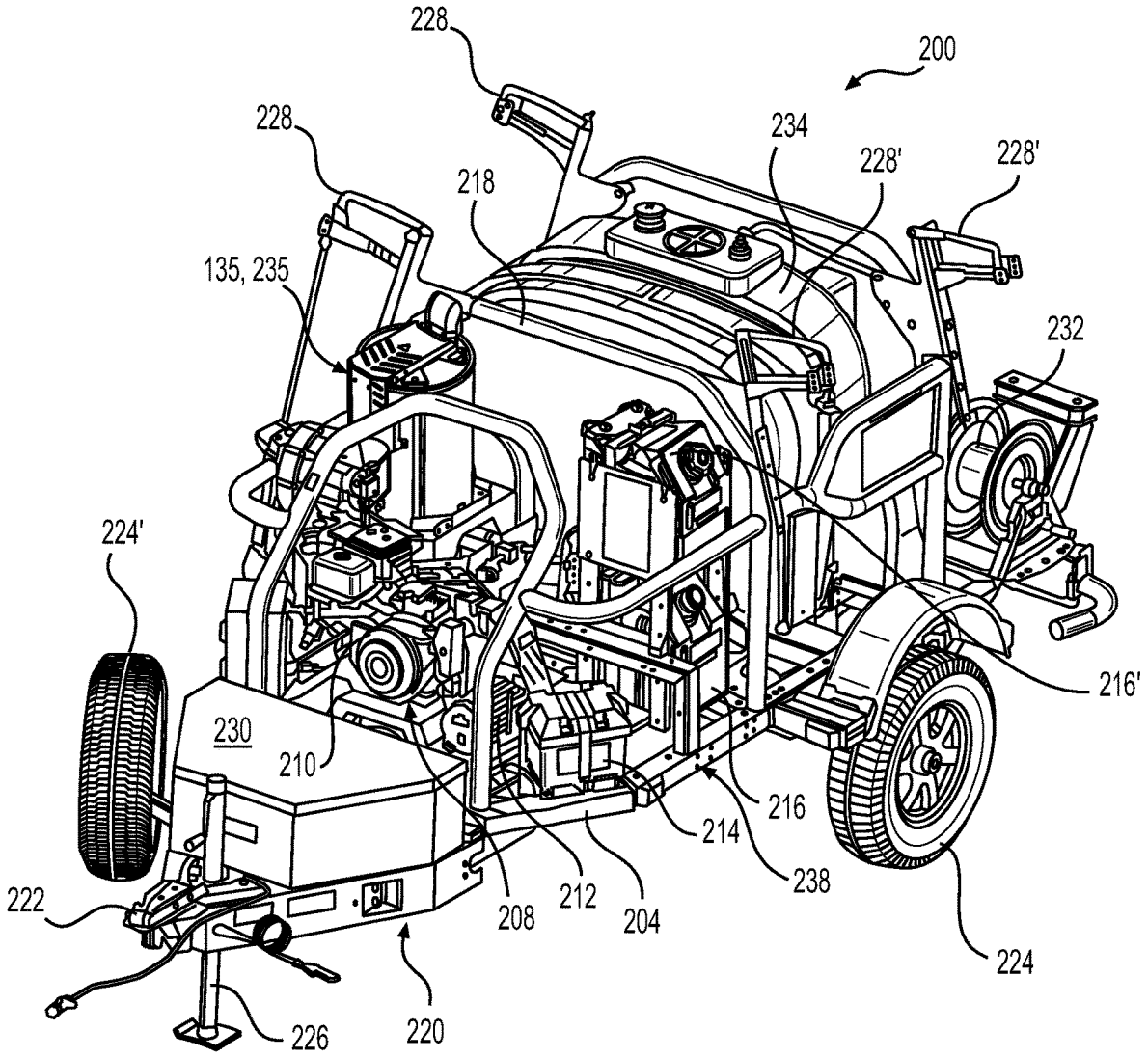
FIG. 2 is a perspective view of a pressure washer mounted on a trailer utilizing a blower and heat exchanger assembly according to an embodiment of the present disclosure similar to the blower and heat exchanger assembly of FIG. 1.

As can be imagined, there are many applications where it is desirable that the pressure washer be portable such as when the area to be cleaned moves frequently or covers a large area. For that reason, a trailer mounted pressure washer 200, as shown in FIG. 2, may be provided. The trailer mounted pressure washer 200 has the same systems and assemblies as described above with respect to the skid mounted pressure washer 100. More specifically, there is a PEG unit 208 including an engine 210 and a generator 212, a battery 214, a blower and heat exchanger assembly 135, 235 including a combustion head (not shown in FIG. 2), a cage portion 218, a skid assembly 238 and two fuel tanks 216.

However, for this embodiment, the legs 106 and ladder frame 102 of the skid mounted pressure washer 100 are removed and only a skid assembly 238 of the trailer mounted pressure washer 200 is mounted onto the trailer ladder frame 220. The trailer ladder frame 220 has a hitch 222 and wheels 224 that allow the trailer ladder frame 220 to be pulled by a vehicle (not shown) to a desired location. A stand 226 is also supplied at the hitch 222 so that the trailer ladder frame 220 may be disconnected from a vehicle while still allowing the trailer mounted pressure washer 200 to remain level or horizontal. This feature may be desirable when the trailer mounted pressure washer 200 may remain in the same place for an undetermined amount of time or if the vehicle is needed elsewhere. Ladder racks 228, a tool compartment 230, and a hose reel 232 are also provided for the convenience of the user. Cleaning fluid tank(s) 234 that may store water or other cleaning solutions are provided. The hose reel 232 may be used to store a hose (not shown) that may be connected to the cleaning fluid tank 234 and a cleaning fluid source such as a water line to supply cleaning fluid to the cleaning fluid tank 234. Or, the hose may be connected to a drain (not shown) located near the bottom of the cleaning fluid tank 234 to facilitate draining of the cleaning fluid tank 234.

Figure 3:
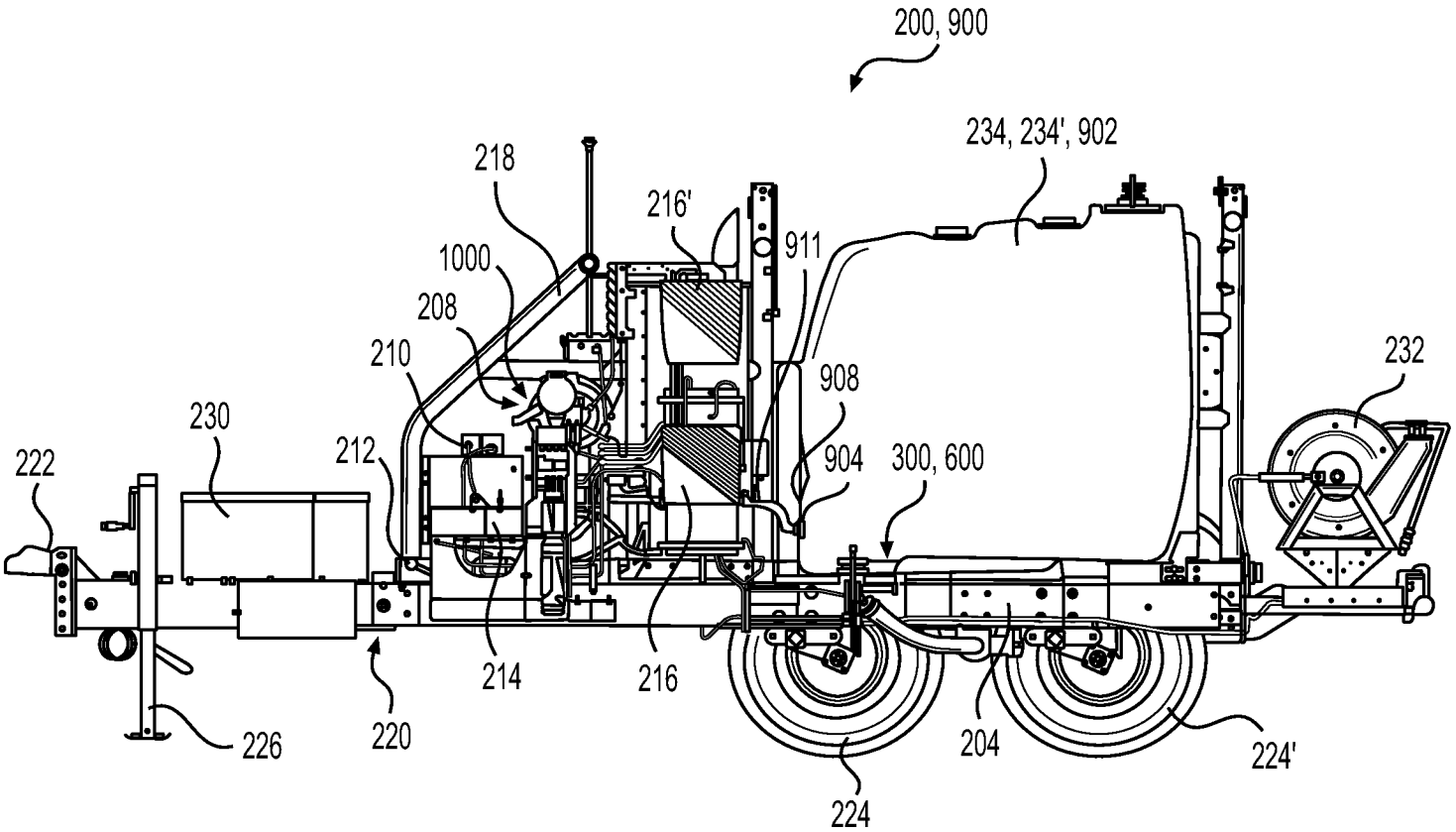
FIG. 3 is a side partial sectional view of a trailer mounted pressure washer similar to that of FIG. 2, showing the low cleaning fluid shutdown system according to an embodiment of the present disclosure including the plumbing of the low cleaning fluid shutdown system.
Figure 4:
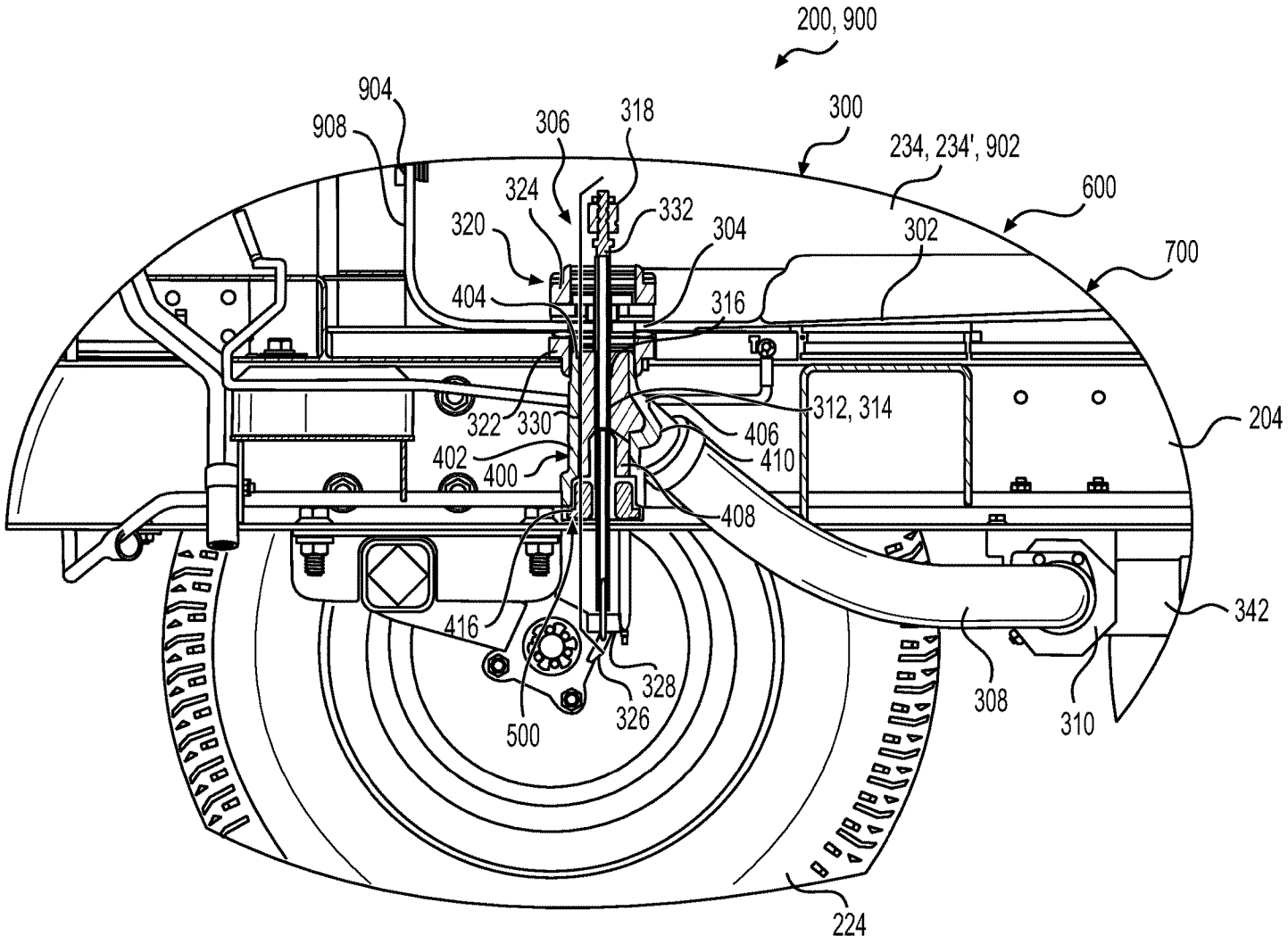
FIG. 4 is an enlarged detail view of the low cleaning fluid shutdown system of FIG. 3, showing more clearly the switch, fittings and connection to the water tank or other cleaning fluid tank.
Figure 5:
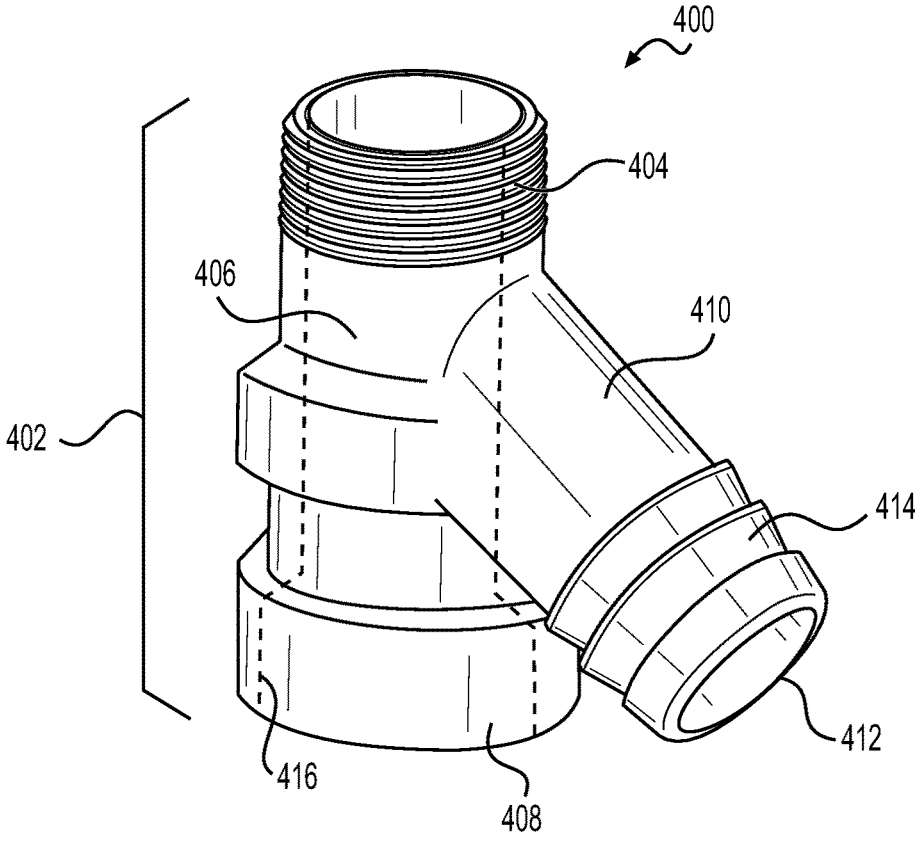
FIG. 5 is a perspective view of a custom angled plumbing fitting used in FIG. 4 that has a hose barb for the connection to the drain and threads for attaching a switch mount fitting.
Figure 6:
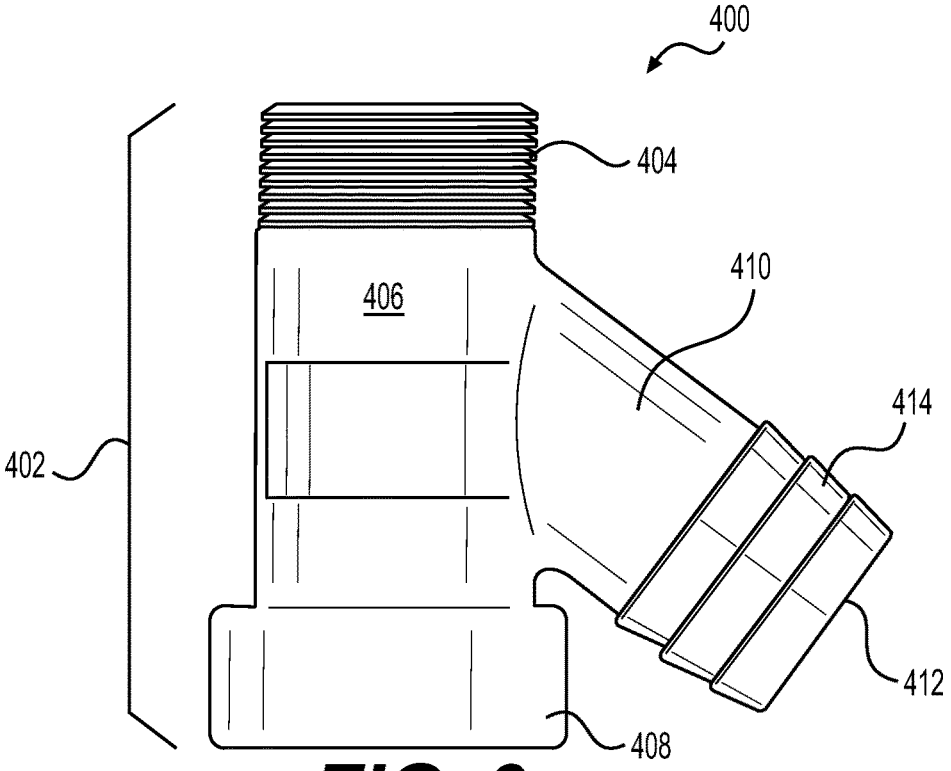
FIG. 6 is a front view of the angled plumbing fitting of FIG. 5.
Figure 7:
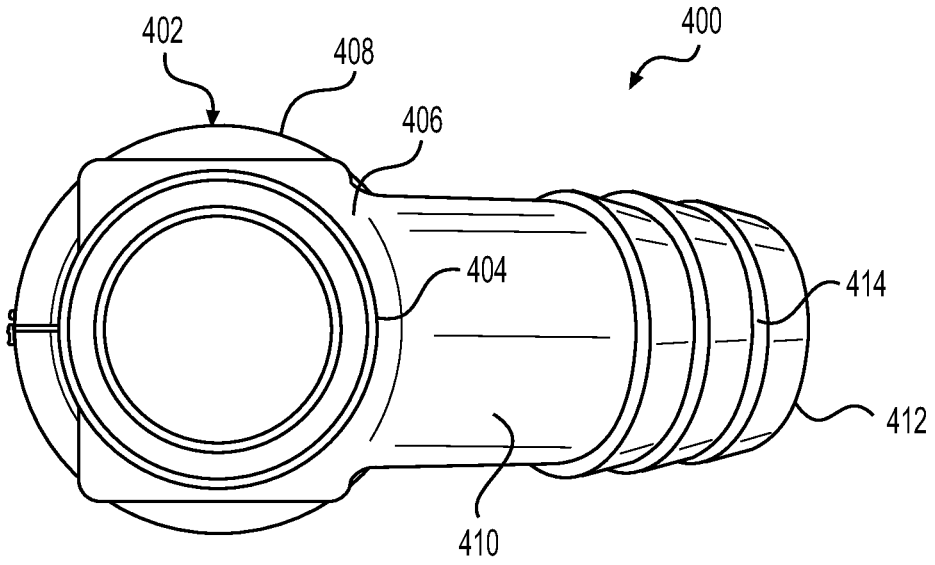
FIG. 7 is a top view of the angled plumbing fitting of FIG. 5.
Figure 8:
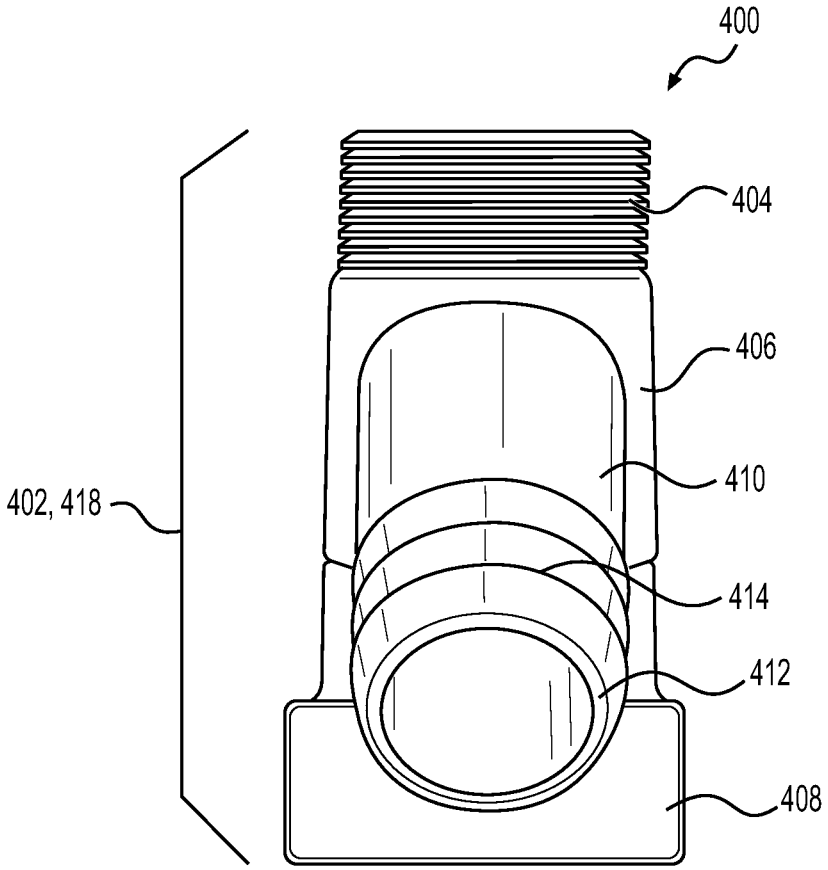
FIG. 8 is a right side view of the angled plumbing fitting of FIG. 5.
Figure 9:
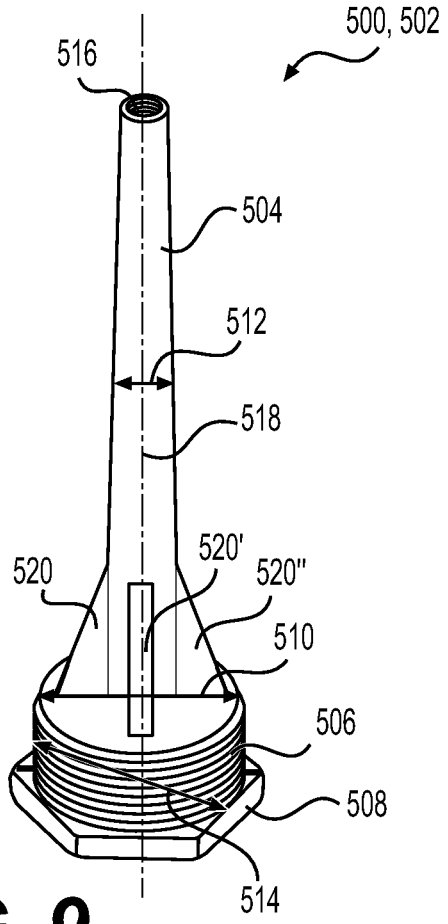
FIG. 9 is a front oriented perspective view of a custom switch mount fitting used in FIG. 4 that is configured for mounting the low cleaning fluid detection switch to the low cleaning fluid shutdown system.
Figure 10:
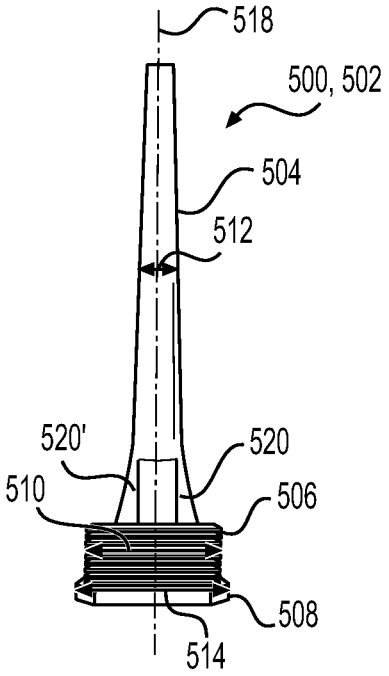
FIG. 10 is a front view of the switch mount fitting of FIG. 9.
Figure 11:
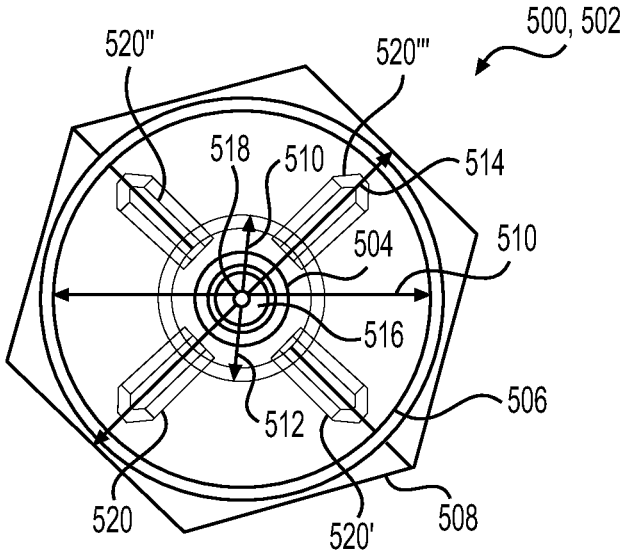
FIG. 11 is a top view of the switch mount fitting of FIG. 9.

FIG. 3 is a side partial sectional view of a trailer mounted pressure washer 200 similar to that of FIG. 2, showing the low cleaning fluid shutdown system 300 according to an embodiment of the present disclosure including the plumbing of the low cleaning fluid shutdown system 300. FIG. 4 shows the low cleaning fluid shutdown system 300 enlarged for enhanced clarity. The system may be referred to in more general terms as a low cleaning fluid shutdown system 300 as something other than water may be used as the cleaning fluid. The term "cleaning" also includes simply rinsing a surface.

Looking at FIGS. 3 and 4, a low cleaning fluid shutdown system 300 for use with a skid mounted pressure washer system 100 and a trailer mounted pressure washer system 200 may be described as follows. The low cleaning fluid shutdown system 300 may comprise a cleaning fluid tank 234 including a bottom wall 302 defining an aperture 304. The cleaning fluid tank 234 may also define a cleaning fluid supply volume 234'. An angled plumbing fitting 400 is provided including a straight portion 402 defining a top section 404, a middle section 406 and a bottom section 408, and an angled portion 410 extending from the straight portion 402. The angled plumbing fitting 400 may be attached to the bottom wall 302 of the cleaning fluid tank 234 and may be in fluid communication with the volume 234' of the of the cleaning fluid tank 234 by extending through the aperture 304 of the bottom wall 302 of the cleaning fluid tank 234. A float switch 306 may be provided that is in operative association with the angled plumbing fitting 400, being at least partially disposed in the cleaning fluid supply volume 234' of the cleaning fluid tank 234 and extending through the straight portion 402 of the angled plumbing fitting 400.

In some embodiments, such as that shown in FIGS. 3 and 4, the low cleaning fluid shutdown system 300 may further comprise a switch mount fitting 500 disposed within the straight portion 402 of the angled plumbing fitting 400 and the float switch 306 is in operative association with the switch mount fitting 500. More particularly, as will be described in further detail below herein, the switch mount fitting 500 may be used to facilitate the assembly of the float switch 306 to the angled plumbing fitting 400.

Furthermore, the low cleaning fluid shutdown system 300 may further comprise a drain tube 308 attached to the angled portion 410 of the angled plumbing fitting 400. The drain tube 308 may extend from the angled plumbing fitting 400 all the way to a drain tube bracket 310 that holds the other end of the drain tube 308 in fixed relation to the underside of the trailer ladder frame 220 of the trailer mounted pressure washer 200. A gate valve fitting 342 may be disposed near this end of the drain tube 308 that can be used by an operator to drain the cleaning fluid tank 234 when needed or desired. The valve may be opened or closed manually or automatically.

The low cleaning fluid shutdown system 300 may also include a micro switch 312, a reed switch 314 or the like that is in operative association with the float switch 306 configured to shut off a pump 1002 (shown later herein) if the float switch 306 falls to a predetermined position. For the embodiment shown, a commercially available float switch 306 sold under the TRADENAME of MADISON COMPANY may be used. In such a case, the micro switch 312 or reed switch 314 may be positioned in the main stem 316 of the float switch 306. When the float member 318 falls under its own weight as the fluid level decreases in the cleaning fluid tank 234, the circuit supplying power to the pump 1002, directly or indirectly, is opened or interrupted, effectively shutting the pump 1002 off, shutting the generator 212 off which powers the pump 1002, or shutting the engine 210 off, which powers the generator 212 off or the pump 1002 off depending on the design. As the float member 318 is pulled upwardly by buoyancy forces as the fluid level in the cleaning fluid tank 234 increases, the circuit is closed, effectively turning the pump 1002 on.

With continued reference to FIGS. 3 and 4, the bottom wall 302 of the cleaning fluid tank 234 is at least partially angled (i.e. not horizontal) toward the aperture 304 of the bottom wall 302 of the cleaning fluid tank 234. This helps to utilize the full cleaning fluid supply volume 234' of cleaning fluid available and to effectively drain the full cleaning fluid supply volume 234' when desired or necessary. This feature may be omitted in other embodiments. The portion of the bottom wall 302 with the aperture 304 may be straight or horizontal whether or not the rest of the bottom wall 302 is angled or non-horizontal. In such a case, such as shown in FIG. 4, the straight portion 402 of the angled plumbing fitting 400 may be essentially vertical.

Focusing on FIG. 4 while also referring to FIGS. 5 thru 8, the top section 404 of the angled plumbing fitting 400 extends upwardly through the aperture 304 of the of the bottom wall 302 of the cleaning supply tank 234 and the switch mount fitting 500 is threaded into the bottom section 408 of the straight portion 402 of the angled plumbing fitting 400. The top section 404 of the angled plumbing fitting 400 is externally threaded and the low cleaning fluid shutdown system 300 further comprises a bulkhead fitting 320 including a lower member 322 with internal threads and an upper member 324 with external threads extending through the aperture 304 below the bottom wall 302 of the cleaning fluid tank 234. The lower member 322 is internally threaded onto the external threads of the upper member 324, thereby holding the bulkhead fitting 320 to the bottom wall 302 of the cleaning fluid supply tank 234. Other arrangements for other embodiments are possible. Also, the top section 404 of the angled plumbing fitting 400 is externally threaded and mated with the internal threads of the lower member 322 of the bulkhead fitting 320, thereby holding angled plumbing fitting 400, switch mount fitting 500 and float switch 306 onto the bottom wall 302 of the cleaning fluid tank 234. Hence, these components are held in their proper working position. The bulkhead fitting 320 may be commercially available under the TRADENAME of BANJO.

Looking solely at FIGS. 5 thru 8, it can be seen that the free end 412 of the angled portion 410 of the angled plumbing fitting 400 includes barbed geometry 414 over which the drain tube 308 may be slipped and retained.

As best seen in FIGS. 4 and 9 thru 11, the switch mount fitting 500 includes an annular hollow body 502 including a thin top section 504, an externally threaded intermediate portion 506 that is wider than the thin top section 504, and a bottom drive portion 508 that is wider than the externally threaded intermediate portion 506. More specifically, the switch mount fitting 500 has a general annular cylindrical configuration but other configurations are possible. So, the diameter 510 of the externally threaded intermediate portion 506 is larger than the diameter 512 of the thin top section 504. The bottom drive portion 508 has a hexagonal configuration for being driven or rotated by a wrench or similar tool. The minimum theoretical diameter 514 of this bottom drive portion 508 is greater than the diameter 510 of the externally threaded intermediate portion 506. This may not be true for other embodiments. The switch mount fitting 500 further defines a central aperture 516 along the cylindrical axis 518 of the switch mount fitting 500 through the thin top section 504, the intermediate portion 506 and the bottom drive portion 508. This central aperture 516 is configured to receive the float switch 306. In some embodiments, the central aperture 516 is internally threaded and receives the stem 316 that has external threads. Four gussets 520 are provided circumferentially at ninety degree intervals, extending from the intermediate portion 506 to the thin top section 504 in order to help provide strength to the thin top section 504.

It should be noted that any of the plastic components discussed herein, such as the switch mount fitting 500 and the angled plumbing fitting 400, may be made from glass filled polypropylene (e.g. 30% glass filled), nylon, glass filed nylon, or any other suitably durable and/or corrosion resistant material.

In some embodiments, a low cleaning fluid shutdown assembly 600 may be sold, manufactured, provided or otherwise obtained. Referring now to FIGS. 4 thru 8, the low cleaning fluid shutdown assembly 600 may comprise an angled plumbing fitting 400 including a straight portion 402 defining a top section 404 and a bottom section 408, and an angled portion 410 extending from the straight portion 402. Once installed, the angled plumbing fitting 400 is attached to the bottom wall 302 of the cleaning fluid tank 234 and being in fluid communication with the cleaning fluid supply volume 234' of the cleaning fluid tank 234 and extending through the aperture 304 of the bottom wall 302 of the cleaning fluid tank 234.

A float switch 306 may be provided that is configured to be in operative association with the angled plumbing fitting 400 at some point during the installation process. The float switch 306 may be at least partially disposed in the cleaning fluid supply volume 234' of the cleaning fluid tank 234 and may extend through the straight portion 402 of the angled plumbing fitting 400. Put another way, the end of the float switch 306 opposite the float member 318 may be configured to extend past the bottom section 408 of the angled plumbing fitting 400, allowing its wires 326 to be attached to the circuit powering a pump 1002. Also, a switch mount fitting 500 may be provided that is configured to be disposed within the straight portion 402 of the angled plumbing fitting 400 (see also FIGS. 9 thru 11).

As alluded to earlier herein with reference to FIGS. 4 thru 8, the top section 404 of the angled plumbing fitting 400 includes external threads, the bottom section 408 of the angled plumbing fitting 400 includes internal threads (best understood with reference to FIG. 4), and the angled portion 410 extending from the straight portion 402 includes a free end 412 with barbed geometry 414. The bottom section 408 of the straight portion 402 of the angled plumbing fitting 400 may be wider than the top section 404 of the straight portion 402 of the angled plumbing fitting 400. This change in geometry may allow the creation of internally threaded counterbore 416 without reducing the wall thickness, which could weaken the wall of the angled plumbing fitting 400.

Focusing now on FIGS. 4 and 9 thru 11, the switch mount fitting 500 includes an annular hollow body 502 including a thin top section 504, an externally threaded intermediate portion 506 that is wider than the top section 504, and a bottom drive portion 508 that is wider than the externally threaded intermediate portion 506, the switch mount fitting 500 further defining a central aperture 516 through the top section 504, the intermediate portion 506 and the bottom drive portion 508, being configured to receive the float switch 306.

Looking at FIG. 4, the float switch 306 may also be provided with this low cleaning fluid shutdown assembly 600. The float switch 306 includes a float member 318, a stem 316 with a first end attached to the float member 318 and a second end, and a nut 328 attached to the second end of the stem 316, the float switch 306 defining an axial length 330 and the angled plumbing fitting 400 defining an axial length 418 (see FIG. 8), and the axial length 330 of the float switch 306 is longer than the axial length 418 of the straight portion 402 of the angled plumbing fitting 400. The switch mount fitting 500 may be attached via threads to the angled plumbing fitting 400 with the float member 318 extending above the top section 404 of the straight portion 402 of the angled plumbing fitting 400 and the nut 328 extending below the bottom section 408 of the angled plumbing fitting 400.

A drain tube 308 may be provided that is configured to be attached to the free end 412 with barbed geometry 414 of the angled portion 410 of the angled plumbing fitting 400 (see FIG. 4).

Figure 12:
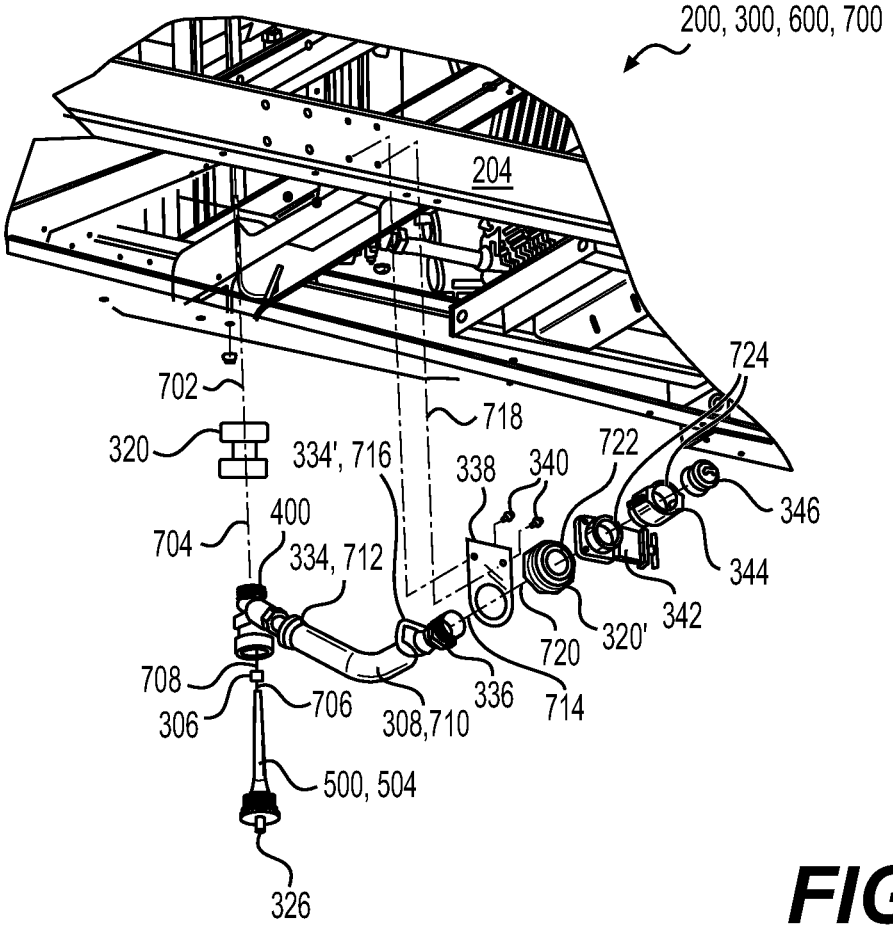
FIG. 12 is an exploded assembly view of the low cleaning fluid shutdown system of FIG. 4.

A method of assembling a low cleaning fluid shutdown assembly such as assembly 600 to a pressure washer will now be described with reference to FIGS. 4 and 12. The method 700 may include the following steps. First, the bulkhead fitting 320 may be attached to the cleaning fluid tank 234 (step 702). Then, the angled plumbing fitting 400 may be attached to the bulkhead fitting 320 as previously described herein (step 704). Also, the float switch 306 may be inserted into the central aperture 516 at the top side of the thin top section 504 of the switch mount fitting 500 until the stop member 332 bottoms out on the thin top section 504 of the switch mount fitting 500 (step 706). Inserting the float switch 306 into the switch mount fitting 500 may be done by threading the stem 316 into the central aperture 516 of the switch mount fitting 500. Then, the switch mount fitting such as switch mount fitting 500 may be threaded into the angled plumbing fitting (step 708) such as angled plumbing fitting 400. The wires 326 may then be attached to the circuitry powering the pump, generator or engine (not shown).

A drain tube 308 may then be attached to the angled portion 410 of the angled plumbing fitting 400 (step 710). A clamp 334 may be used to retain the drain tube 308 onto the angled portion 410 of the angled plumbing fitting 400 (step 712), Then, a piece of hose barb fitting 336 may be inserted into the other end of the drain tube 308 (step 714), being held thereto using another clamp 334' (step 716). A drain tube bracket 333 may be attached to a frame portion 204 of the trailer mounted pressure washer 200 using fasteners 340 (step 718). Next, the hose barb fitting 336 may be attached to the drain tube bracket 338 using a drain tube outlet bulkhead fitting 320' in a manner previously described above (step 720). A gate valve fitting 342 is then attached to the drain tube outlet bulkhead fitting 32W on the other side of the drain tube bracket 338 (step 722), allowing draining to occur when needed or desired as mentioned previously. A quick connect socket 344 and quick connect plug 346 may then be attached (step 724) to allow the drain line to be quickly connected or disconnected from a drain reservoir or similar type of fluid line.

Figure 14:
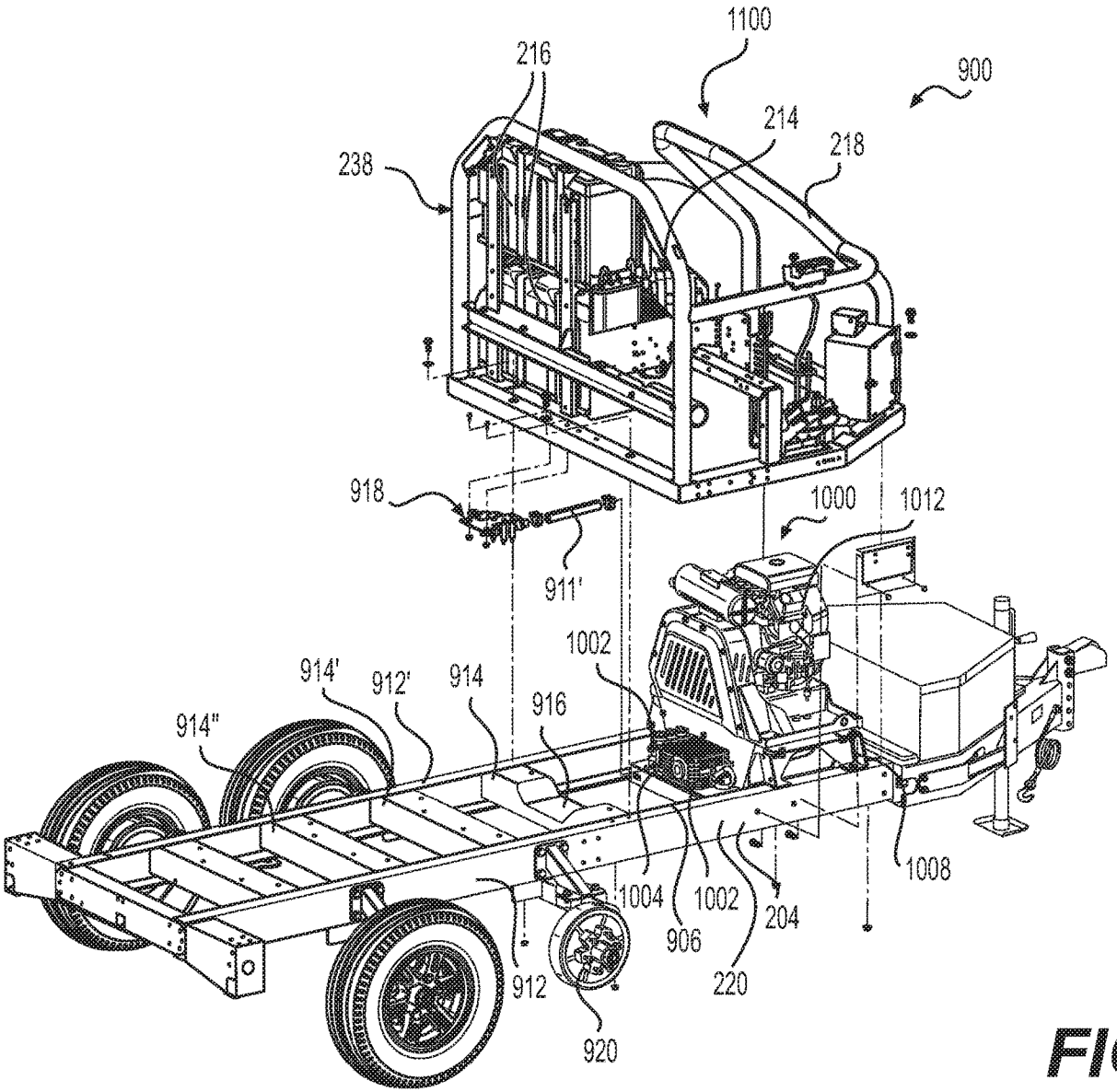
FIG. 14 is a rear oriented perspective view of the trailer mounted pressure washer of FIG. 3, showing a pump, engine, and generator unit ("PEG" unit) mounted onto the trailer ladder frame of the trailer mounted pressure washer and the skid assembly including a cage portion, fuel tanks, and battery exploded away from the trailer mounted pressure washer.
Figure 15:
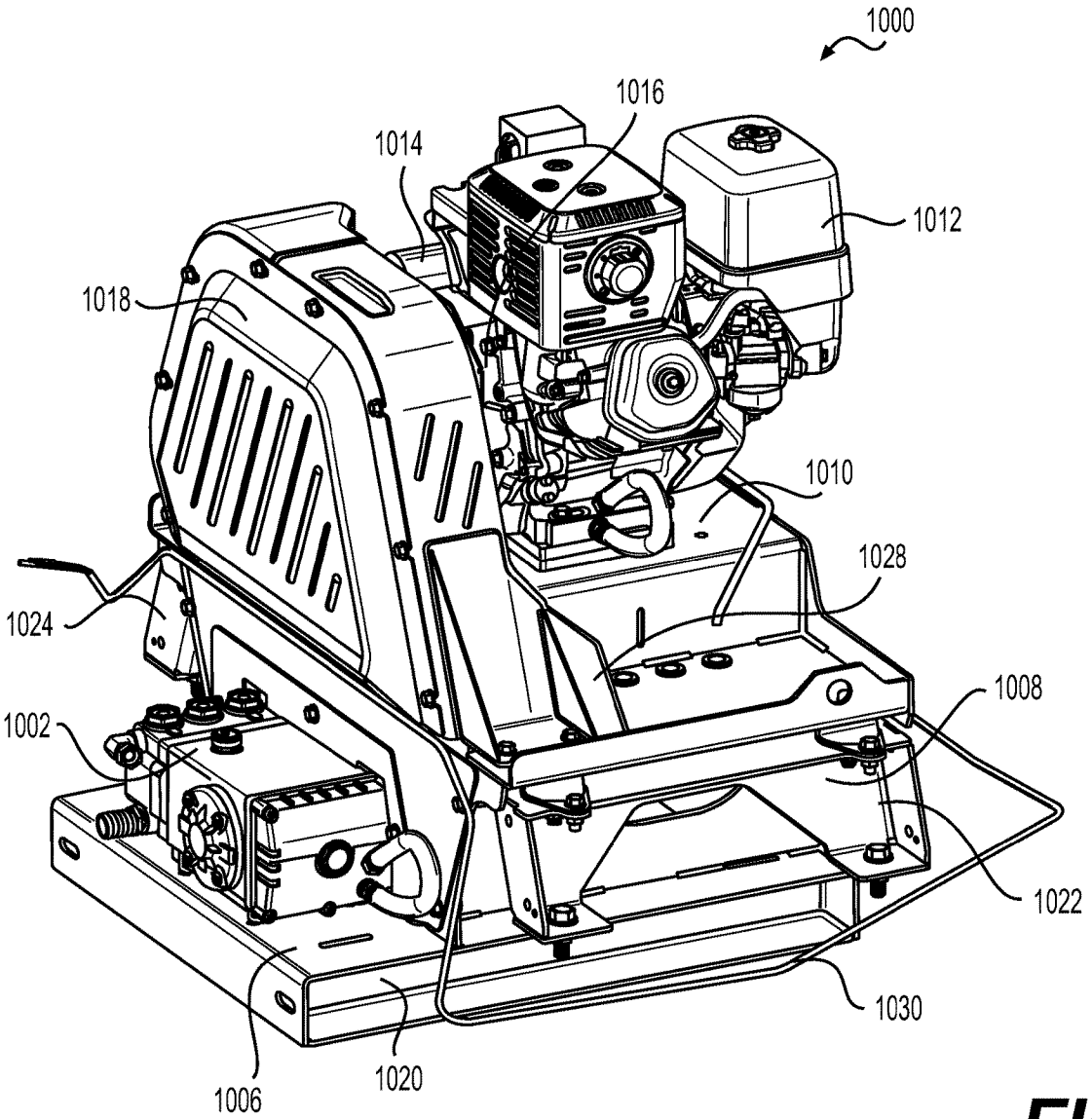
FIG. 15 is a perspective view of the PEG unit of FIG. 14 removed from the trailer mounted pressure washer.
Figure 16:
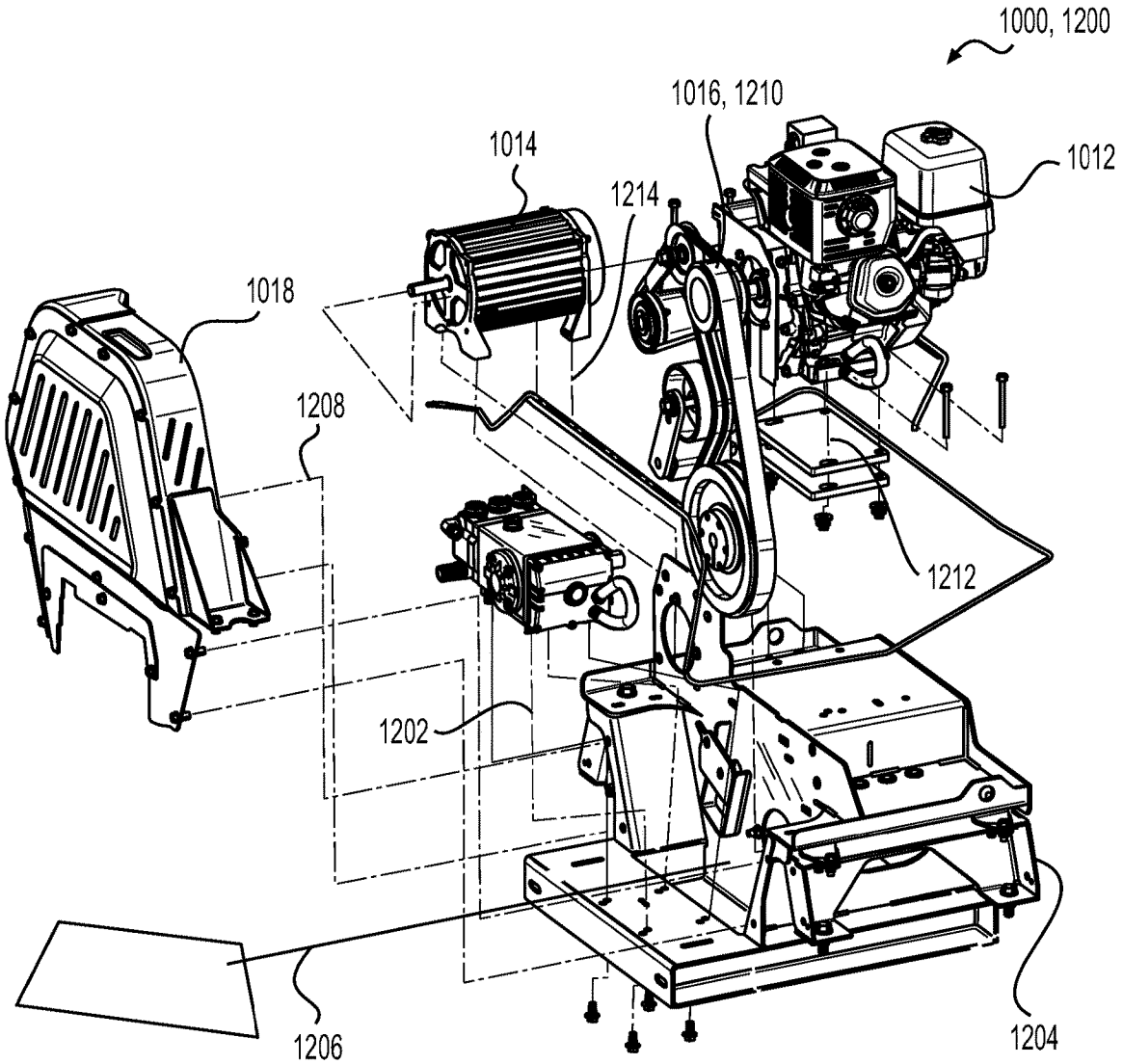
FIG. 16 is an exploded assembly view of the PEG unit of FIG. 15.

Referring now to FIGS. 14 thru 16, an embodiment of a power, engine and generator unit ("PEG" unit 1000) of the present disclosure will now be described that may be useful in reducing the likelihood of the induction of air into and/or cavitation in the pump 1002, decreasing the likelihood of damage to the pump 1002. The PEG unit 1000 is designed or intended to fit into multiple platforms (e.g. skids, trailers, skids with water tanks etc.) while also positioning the pump 1002 below the bottom of the feed water tank (cleaning fluid supply tank 234). Positioning the pump 1002 below the fluid level creates a positive pressure at the pump's inlet (pump inlet 1004) which improves priming and increases the life of the pump 1002. This is different than typical pressure washer systems that are fed from a cleaning supply tank 234 usually have a negative inlet pressure which increases the likelihood and the frequency of cavitation occurring, which damages pump components and decreases pump life.

Looking a FIGS. 3, 4 and 14, a pressure washer system 900 according to an embodiment of the present disclosure comprises a cleaning fluid supply tank 902 defining a cleaning fluid supply outlet 904, and a pump, engine and generator unit (PEG unit 1000) including a pump 1002 defining a cleaning fluid pump inlet 1004 disposed vertically below the cleaning fluid supply outlet 904 of the cleaning fluid supply tank 902. The pressure washer system 900 may further comprise a trailer ladder frame 220 defining a cleaning fluid tank support surface 906 and the cleaning fluid tank 902 is seated on the cleaning fluid tank support surface 906. The cleaning fluid pump inlet 1004 is disposed vertically below the cleaning fluid supply tank support surface 906. This may help provide a positive inlet pressure for the pump 1002. A suitable distance may be used to create the desired hydraulic head such as six inches to one foot. This distance may be varied as needed or desired in other embodiments.

More specifically, focusing on FIGS. 3 and 4, the cleaning fluid tank 902 includes a rear wall 908, a bottom wall 302 and the rear wall 908 defines the cleaning fluid supply outlet 904, and the bottom wall 302 defines a drain aperture 304. The pressure washer system 900 may further comprise a conduit 911 connecting the cleaning fluid supply outlet 904 to the pump inlet 1004 (top portion of the conduit 911 is shown in FIGS. 3 and 4 while the bottom portion of the conduit 911' is shown in FIG. 14). The relative positioning of the cleaning fluid supply outlet may be strategically positioned vertically relative to the float switch so that the float switch will shut off the pump before air will reach the pump.

As best seen in FIG. 15, the pump, engine and generator unit (PEG unit 1000) includes a lower pump support platform 1006, with the pump 1002 shown attached to the rear portion thereof, and an upper frame attachment portion 1008 that is positioned vertically above the lower pump support platform 1006. The upper frame attachment portion 1008 is so called since it is used to attach the PEG unit 1000 to the trailer ladder frame 220 of the pressure washer system 900 (see FIG. 14). Furthermore, an engine and generator support platform 1010 is disposed above the upper frame attachment portion 1008. An engine 1012 and/or a generator 1014 are attached to or seated onto the engine and the generator support platform 1010. The engine 1012 and the generator 1014 may be positioned on the engine and generator support platform 1010 and may be disposed vertically above the lower pump support platform 1006 and the upper frame attachment portion 1008. As a consequence, as best understood with reference to FIG. 14, the generator 1014 and the engine 1012 are easily accessed for maintenance and the like.

In addition, as shown in FIGS. 15 and 16, a belt tensioning system 1016 and a shroud 1018 (or guard) are provided. The shroud 1018 is positioned adjacent the generator 1014, the engine 1012 and the belt tensioning system 1016, covering at least a portion of the engine 1012, at least a portion of the generator 1014, and the belt tensioning system 1016.

Referring back to FIG. 14, the trailer ladder frame 220 comprises at least two longitudinal members 912 and at least one cross-member 914 connecting the two longitudinal members 912 together. The longitudinal members 912 may essentially have an I-beam or C-channel configuration. On the other hand, the cross-members 914 may have an essentially hollow square shape. The cross-member 914 nearest the PEG unit 1000 may have a cutout 916 that is configured to receive a tongue portion of a cleaning fluid supply tank. Also, a filter assembly 918 is provided to be attached to the lower portion of the conduit 911', both of which are also configured to be seated in the cutout 916 of the cross-member 914 once the assembling process is completed. A fuel and energy supply assembly 1100 including the cage portion 218, battery 214, fuel tanks 216, etc. may also be provided as shown. A rotor 920 is shown to which a wheel may be attached.

Focusing on FIG. 15, the pump, engine and generator unit (PEG unit 1000) may comprise a pump 1002, an engine 1012 and a generator 1014, a lower pump support platform 1006, and an engine and generator support platform 1010 as previously described earlier herein. The upper frame attachment portion 1008 is positioned vertically above the lower pump support platform 1006. The engine 1012 and generator 1014 are positioned on the engine and generator support platform 1010, which is disposed vertically above the lower pump support platform 1006 and the pump 1002 is positioned on the lower pump support platform 1006. The engine and generator support platform 1010 is also above the upper frame attachment portion 1008.

The lower pump support platform 1006 includes rectangular hollow configuration with at least one vertical reinforcement member 1020 disposed in the rectangular hollow configuration. The engine and generator support platform 1010 is positioned above the upper frame attachment portion 1008. The first attachment portion 1022 and second attachment portion 1024 are identical pieces that can both be described as an upper frame attachment portion 1008. The first attachment portion 1022 and second attachment portion 1024 are attached to the engine and generator support platform 1010 by using iso-mounts (not shown). The pump 1002 may rest on the lower pump support platform 1006 and may be attached to the engine and generator support platform 1010 via vertical attachment plate 1028. A wire 1030 may attached to the upper frame attachment portion 1008 and the engine and generator support platform 1010 for grounding purposes. The first side attachment portion 1022 includes a bent or formed sheet metal configuration. The second side attachment portion 1024 is similarly constructed. The width between the first and second side attachment portions is greater than the width of the lower pump support platform. Consequently, the first and second side attachment portions overhang, allowing the PEG unit to be attached to the frame while the pump is placed beneath the top surface of the frame.

The engine 1012 may be a commercially available engine, the pump 1002 may be a commercially available pump, and the shroud 1018 may be a plastic injection molded component or may be a sheet metal formed component or assembly. For example, the engine 1012 may be sold under the TRADENAME of KOHLER having a model no. of ECH630 EFI and the pump 1002 may be sold under the TRADENAME of GP having a model no. of TSF1819. Other types of engines and pumps may be provided. The pump 1002 may be powered using an electrical outlet and cord in other embodiments, eliminating the need for an engine and/or a generator.

FIG. 16 illustrates a method of assembly for the PEG unit 1000. The method 1200 for assembling a PEG unit includes attaching the pump to the lower pump support platform (step 1202). The method further includes attaching the lower pump support platform to the upper frame attachment portion (step 1204) and attaching the vertical attachment plate to the lower support platform (step 1206). The method may further comprise attaching the shroud to the engine and generator support platform (step 1208) and adjusting the belt tensioning system (step 1210) and attaching the engine and the belt tensioning system to the engine and generator support platform (step 1212). Similarly, the generator may be attached to the engine and generator support platform (step 1214).

INDUSTRIAL APPLICABILITY

In practice, a low cleaning fluid shutdown system, a low cleaning fluid shutdown assembly, an angled plumbing fitting, a switch mount assembly, and/or a pressure washer according to any embodiment described herein may be provided, sold, manufactured, and bought etc. or otherwise provided as needed or desired in an aftermarket or OEM (Original Equipment Manufacturer) context. It is to be understood that any of these embodiments may differently be sized and configured compared to any version specifically shown in the figures. Other components of the low cleaning fluid shutdown assembly may also be provided as a replacement part.

For example, an angled plumbing fluid fitting 400 for use with a low cleaning fluid shutdown system 300 of a pressure washer may be provided as a replacement part. The angled plumbing fitting 400 may comprise a straight portion 402 including a top externally threaded portion 404, an intermediate portion 406, and a bottom internally threaded portion 408, and an angled portion 410 extending from the intermediate portion 406 and terminating at a free end 412. The free end 412 of the angled portion 410 has barbed geometry 414 and the bottom section 408 of the straight portion 408 is wider than the top section 404 of the straight portion 402 and the intermediate portion 406 of the straight portion 402. The angled portion 410 may extend from the straight portion 402 at a 55 degree angle pointed downward alongside of the bottom internally threaded portion 408. This angle may be adjusted as needed or desired in other applications.

Likewise, a switch mount fitting 500 for use with a low cleaning fluid shutdown system 300 of a pressure washer may be provided as a replacement part. The switch mount fitting 500 may comprise an annular hollow body 502 including a thin top section 504, an intermediate externally threaded portion 506 that is wider than the thin top section 504, and a bottom drive portion 508, the switch mount fitting further defining a central aperture 516 through the thin top section 504, the intermediate portion 506 and the bottom drive portion 508 being configured to receive a float switch 306. In some embodiments, the central aperture 516 is internally threaded. The switch mount fitting 500 may further comprise a plurality of gussets 520 extending from the externally threaded intermediate portion 506 to the thin top section 504 and the bottom drive portion 508 is wider than the externally threaded intermediate portion 506, including a hexagonal perimeter configured to be driven by a wrench.

Figure 13:
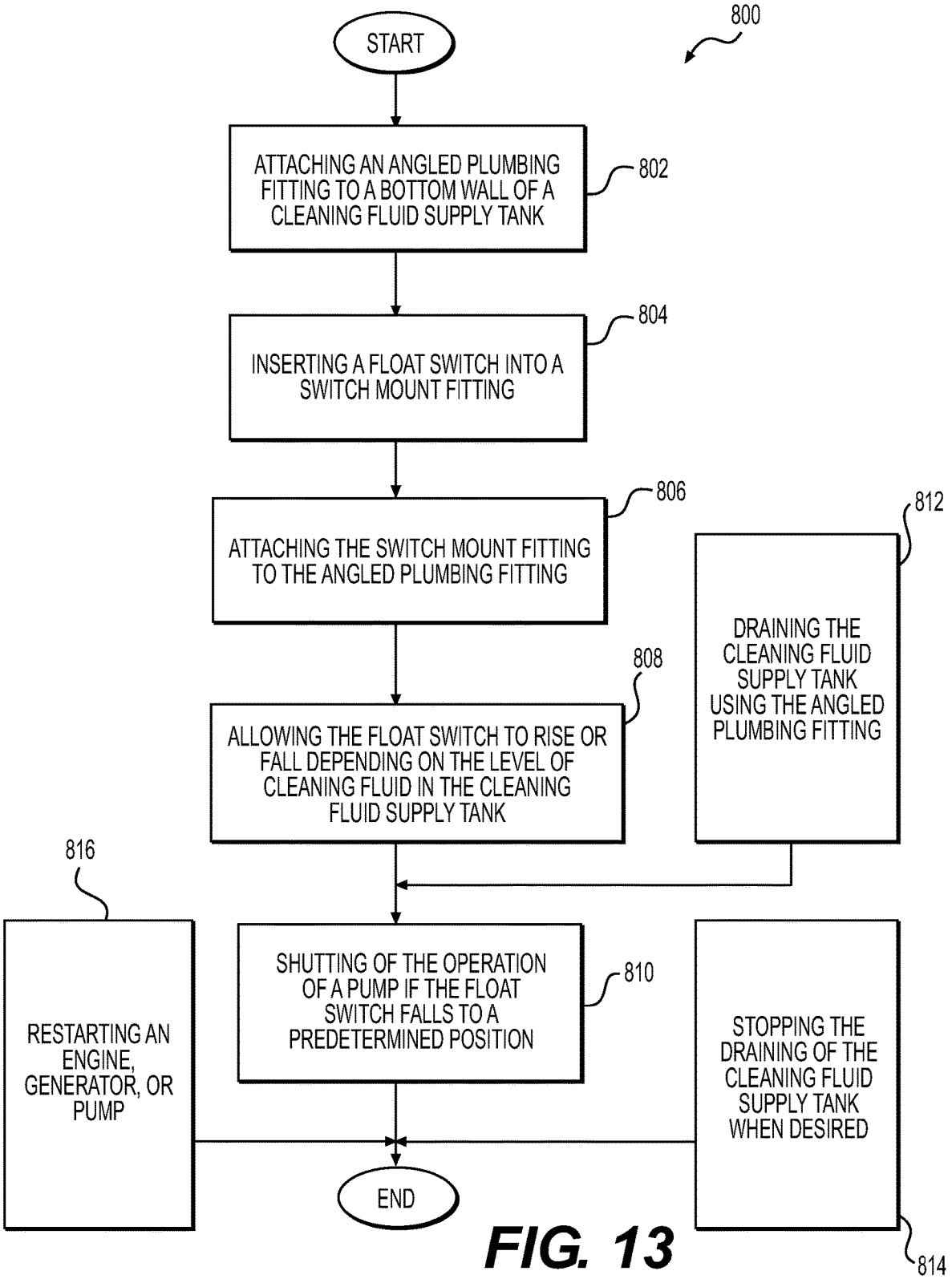
FIG. 13 is a flow chart depicting a method of using a low cleaning fluid shutdown system according to an embodiment of the present disclosure.

A method of using a low cleaning fluid shutdown system 300 will now be described with reference to FIG. 13. The method of use 800 may comprise attaching an angled plumbing fitting to a bottom wall of a cleaning fluid tank (step 802), inserting a float switch into a switch mount fitting (step 804), and attaching the switch mount fitting to the angled plumbing fitting (step 806).

The method of use 800 may further comprise allowing the float switch to rise or fall depending on the level of cleaning fluid in the cleaning fluid supply tank (step 808).

The method of use 800 may further comprise shutting off the operation of a pump if the float switch falls to a predetermined position (step 810). This may be done by removing the power supplied to the pump such as pump 1002 whether it be electrical, mechanical, hydraulic, pneumatic, etc.

The method of use 800 may further comprise draining the cleaning fluid tank using the angled plumbing fitting (step 812).

The method of use 800 may further comprise stopping the draining of the cleaning fluid supply tank when desired (step 814). In situations where the pump such as pump 1002 is stopped by turning off the engine such as engine 1012, it may be required to start the engine, generator such as generator 1014 or pump once more if pressure washing is desired to be resumed (step 816).

Also, in practice, a PEG unit, a fuel and energy supply assembly and/or a pressure washer system using a PEG unit may be provided in an OEM or aftermarket context according to any embodiment of the present disclosure. In like fashion, a method for assembling a PEG unit or supplying a cleaning fluid to a pump for a pressure washer may also be provided.

Figure 17:
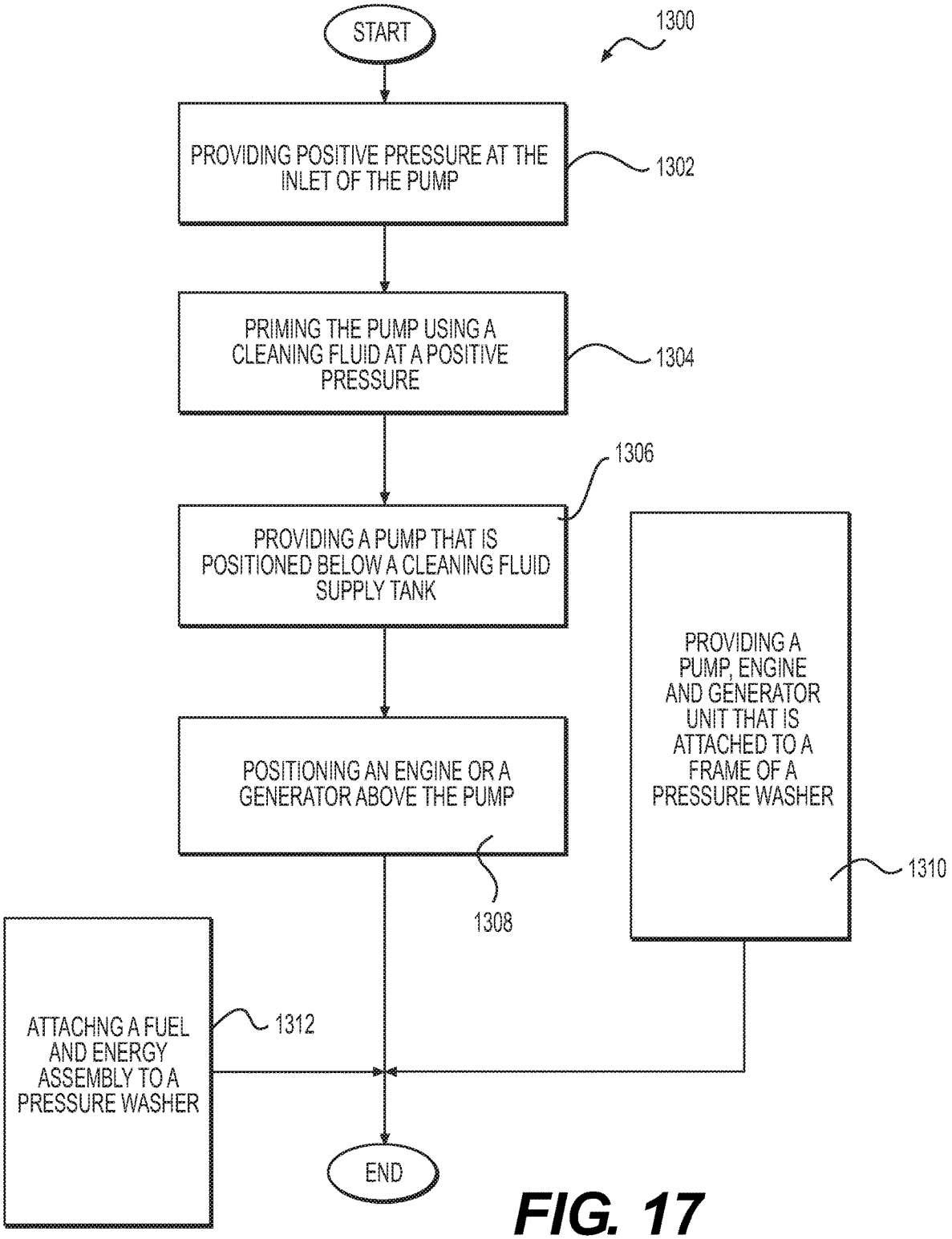
FIG. 17 is a flow chart illustrating a method for supplying a cleaning fluid to a pump for a pressure washer system.

FIG. 17 contains a method 1300 for supplying a cleaning fluid to a pump such as pump 1002 for a pressure washer. The method 1300 for supplying a cleaning fluid to a pump such as pump 1002 comprises providing positive pressure at the inlet of the pump (step 1302). The method 1300 for supplying a cleaning fluid to a pump such as pump 1002 may further comprise priming the pump using a cleaning fluid at a positive pressure (step 1304) and providing a pump that is positioned below a cleaning fluid tank (step 1306).

The method 1300 for supplying a cleaning fluid to a pump such as pump 1002 may further comprise positioning an engine or a generator above the pump (step 1308) and providing a pump, engine and generator unit (PEG unit) that is attached to a frame of a pressure washer system (step 1310). This method may also comprise attaching a fuel and energy assembly to a pressure washer system (step 1312).

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

What is claimed is:

1. A pressure washer system that reduces the possibility of air being introduced into a pump, or otherwise decreases the probability of cavitation and the associated risk of damage to the pump, comprising:

a cleaning fluid supply tank defining a cleaning fluid supply outlet;

a PEG unit including the pump, said pump defining a cleaning fluid pump inlet disposed vertically below the cleaning fluid supply outlet of the cleaning fluid supply tank, wherein the pump is supported on a lower pump support platform, and an engine or generator of the PEG unit is attached to an engine and generator support platform of the pressure washer system, and the engine or generator of the PEG unit is positioned above the pump, wherein the cleaning fluid supply tank includes a rear wall and a bottom wall, the rear wall defines the cleaning fluid supply outlet, and the bottom wall defines a drain aperture.

2. The pressure washer system of claim 1, further comprising a conduit connecting the cleaning fluid supply outlet to the cleaning fluid pump inlet.

3. A pressure washer system that reduces the possibility of air being introduced into a pump, or otherwise decreases the probability of cavitation and the associated risk of damage to the pump, comprising:

a cleaning fluid supply tank defining a cleaning fluid supply outlet;

a PEG unit including the pump, said pump defining a cleaning fluid pump inlet disposed vertically below the cleaning fluid supply outlet of the cleaning fluid supply tank, wherein the pump is supported on a lower pump support platform, and an engine or generator of the PEG unit is attached to an engine and generator support platform of the pressure washer system, and the engine or generator of the PEG unit is positioned above the pump;

a trailer ladder frame defining a cleaning fluid supply tank support surface wherein the cleaning fluid supply tank is seated on the cleaning fluid supply tank support surface and the cleaning fluid pump inlet is disposed vertically below the cleaning fluid supply tank support surface;

a belt tensioning system;

a shroud positioned adjacent the generator, the engine and the belt tensioning system, the shroud covering at least a portion of the engine, at least a portion of the generator, and the belt tensioning system, wherein the PEG unit includes the lower pump support platform and an upper frame attachment portion that is positioned vertically above the lower pump support platform, and wherein the PEG unit comprises said engine and said generator, and further comprises the engine and generator support platform, and the engine and generator are positioned on the engine and generator support platform that is disposed vertically above the lower pump support platform.

* * * * *